United States Patent [19]

Delves-Broughton et al.

[11] 3,947,343

[45] Mar. 30, 1976

[54] ELECTROTINNING WIRE

[75] Inventors: James Delves-Broughton, Nathern near Chepstow; Victor A. C. Burton, Wickford; Barry A. Kempster, Bexley; Thomas J. Williams, Woodford Green, all of England

[73] Assignee: International Standard Electric Corporation, New York, N.Y.

[22] Filed: Apr. 3, 1974

[21] Appl. No.: 457,515

[30] Foreign Application Priority Data

Apr. 5, 1973 United Kingdom ..... 16274/73

[52] U.S. Cl. ..... 204/207; 204/28; 204/206; 204/211; 204/286

[51] Int. Cl.[2] B65G 49/02; C25D 17/12; C25D 7/06

[58] Field of Search ..... 204/28, 206–211

[56] References Cited

UNITED STATES PATENTS

| | | | |
|---|---|---|---|
| 1,120,191 | 12/1914 | Gibbs | 204/207 |
| 2,576,074 | 11/1951 | Nachtman | 204/206 X |
| 2,657,177 | 10/1953 | Rendel | 204/211 |
| 2,757,137 | 7/1956 | Petrovich et al. | 204/211 |
| 2,823,180 | 2/1958 | Rothschild | 204/207 |
| 2,946,734 | 7/1960 | Roy et al. | 204/211 X |
| 3,414,501 | 12/1968 | Kruger | 204/206 |
| 3,669,866 | 6/1972 | Girard et al. | 204/207 |

FOREIGN PATENTS OR APPLICATIONS

| | | |
|---|---|---|
| 1,302,793 | 4/1970 | United Kingdom |

*Primary Examiner*—G. L. Kaplan
*Assistant Examiner*—Aaron Weisstuch
*Attorney, Agent, or Firm*—John T. O'Halloran; Menotti J. Lombardi, Jr.

[57] ABSTRACT

Apparatus for degreasing and electroplating wire with a high current density electrolyte at high speeds includes a supply reel, guide pulleys, driving drums, degreasing and washing tanks, plating tanks and a take-up reel. The speeds of the driving drums for plating and degreasing are related and controlled in accordance with wire tension by means of a pulley, spring-based pivotable dancer arm, and a variable resistor. Fluid drag by wires running in one direction is eliminated by placement of a plurality of closely spaced anodes across the top of the plating bath and a flow stabilizer plate over the degreasing tank. A control circuit provides a desired constant ratio between drive speed and plating current.

14 Claims, 7 Drawing Figures

ELECTROTINNING WIRE

BACKGROUND OF THE INVENTION

1. Field of the Invention

This invention relates to methods and apparatus for continuously electroplating wire, and particularly to an improved method and apparatus for electrotinning copper wire at high speeds and with high current densities.

2. Description of the Prior Art

One known method of continuously electrotinning a copper wire employs stannous sulphate for the electrolyte. This method basically comprises passing a longitudinally moving copper wire a plurality of times through an electrolyte tank, each time passing the wire around an electrically-conducting driven grooved drum, which is connected to the negative pole of a d.c. current source, and a separate one of a plurality of insulated pulleys, the anodic current being supplied via anodes of tin immersed in the electrolyte. Typically the apparatus is such that the wire is horizontal when being planted, and it passes alternately through two plating tanks which are arranged one above the other between the pulleys and the drum. Using such an arrangement with stannous sulphate, electrolyte current densities of the order of 100 amps per square ft. (1076 amps per square meter) are employed, and the wire moves at a rate of 500 ft. (152 meters) per minute, the plating thickness being built up gradually during passage through the electrolyte.

Electrolytes capable of higher current densities of the order of, for example, 400 amps per square ft. (4,304 amps per square meter) are now available, for example stannous fluoroborate (also known as stannous fluoborate) and other fluoroborate-based plating solutions, with the result that with the same basic method and apparatus, plating rates four times greater than obtainable with stannous sulphate, for example, can be achieved.

The use of stannous fluoroborate or other fluoroborate based printing solutions, however, result in a number of practical problems. The highly corrosive nature of the electrolyte means that plastics materials or special steels need to be used for the tanks, pipework and pumps. In the above-mentioned practical arrangement for tin plating a copper wire using stannous sulphate, the tin anodes are positioned in the electrolyte tanks below the moving wire, but this produces problems, when using stannous fluoroborate, for example, in the method of connecting the anodes to their associated bus bars to that the latter are not corroded. In order to cope with the high current density (400 amps per square ft. or 4,304 amps per square meter) the wire must be arranged to pass in sufficient loops through the electrolyte tanks so as to pass the current without causing overheating.

In addition, the very much higher running speeds which can be achieved with fluoroborate-based solutions, for example up to four or more times the previous speeds, that is speeds of 2000 ft. (610 meters) per minute can cause hydrodynamic drag effects on the electrolyte in the tanks. With a large number of portions of wire passing through one tank in the same direction and at high speed, quite a considerable wave of electrolyte can be caused to move in this direction and spill over the end of the tank. This problem also occurs in connection with other processes, and the usual methods used to counteract it involve complex systems of weirs or other baffles.

It has already been proposed in our co-pending U.S. Pat. application Ser. No. 381,954, filed July 23, 1973, now U.S. Pat. No. 3,869,371, and assigned to the same assignee as the instant application, to overcome the above-mentioned hydrodynamic drag problem by use of apparatus which includes a single horizontal tank of electrolyte (for example stannous fluoroborate) and by passing the wire a plurality of times through the single tank, each time passing it in a loop around two rotatable drums between which the tank is positioned, spacing and deflector means being positioned between the bath and the drums so as to cause the portions of the wire loop sections passing through the bath to be in a substantially common horizontal plane with alternate wire loop sections moving in opposite directions. The effects of hydrodynamic drag in one direction are, therefore, substantially compensated for by the effects of drag in the other direction. In that case it was also proposed to dip the anode electrodes from above, in order to facilitate electrical connection thereto.

It has now been found that it is possible to use high current density electrolytes at high wire throughout speeds and at high plating currents without involving overheating and fluid drag problems, and without necessarily having to resort to the above-described design of plating equipment proposed by our co-pending application.

SUMMARY OF THE INVENTION

It is, therefore, an object of the present invention to provide alternative simplified methods and apparatus for continuously electroplating a wire using a high current density electrolyte, and/or another high speed plating process, in which problems associated with hydrodynamic drag and wire overheating are substantially eliminated.

According to one aspect of the present invention, this is achieved by providing apparatus for continuously depositing a metal coating on a longitudinally moving wire, including means for passing the wire a plurality of times through one or more degreasing tanks containing a degreasing solution, each time passing the wire in a loop around two rotatable drums, at least one of which is drivable. Means are also included for passing the degreased wire a plurality of times through one or more plating tanks containing an electrolyte consisting of a salt of the metal to be deposited, each time passing the wire in a loop around two rotatable plating drums, at least one of which is drivable, at least one of the plating drums being connectible to the negative pole of a source of direct current, anode current being supplied through one or more anodes made of the metal to be deposited which extend into the electrolyte. The drive means for the drivable plating drum and the drivable degreasing drum are inter-related but such that, in dependence on the wire tension, there may be up to a predetermined amount of variation in the speed of the wire through the degreasing tank or tanks with respect to the speed of the wire through the plating tank or tanks.

According to another aspect of the present invention there is provided a method of continuously depositing a metal coating on a longitudinally moving wire, including the steps of passing the wire a plurality of times through one or more degreasing tanks containing a degreasing solution, each time passing the wire in a loop around two rotatable drums, at least one of which is drivable, and subsequently passing the degreased wire a plurality of times through one or more plating tanks containing an electrolyte consisting of a salt of the metal to be deposited. Each time the wire is passed in a loop around two rotatable electrically-conducting plating drums, at least one of which is drivable, at least one of the plating drums being connectible to a source of direct current, anodic current being supplied through one or more anodes made of the metal to be deposited. In addition, drive means for the drivable plating and degreasing drums are interrelated, and the drive speed of the driven degreasing drum is controlled such that, in dependence on the tension of the wire, the speed may be varied by an amount with respect to the drive speed of the driven plating drum which lies between predetermined limits.

An embodiment of the invention will now be described with reference to the accompanying drawings.

BRIEF DESCRPITION OF THE DRAWINGS

DESCRIPTION OF THE PREFERRED EMBODIMENT

Figure 1:
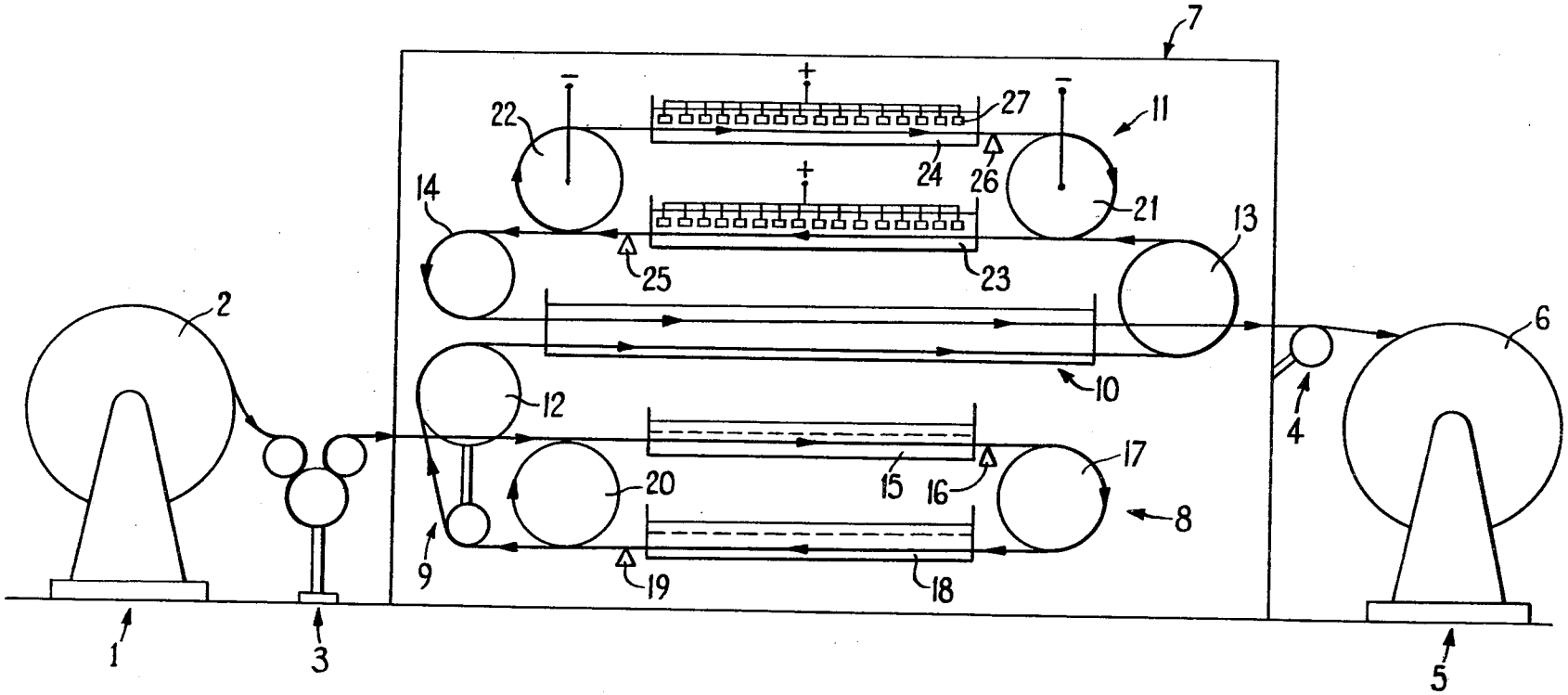
FIG. 1 shows a schematic layout of apparatus for use in continuously electroplating a wire according to an embodiment of the present invention.

The apparatus shown in FIG. 1 includes a stand 1 for a wire supply reel 2, the reel being rotatable on pintles (not shown) of the stand 1, a guide pulley arrangement 3, a guide pulley 4, a drivable wire take-up reel stand 5 and a take-up reel 6. The items within the housing 7 constitute the actual plating plant and associated equipment, and basically include an electrolytic degreasing arrangement 8, a tension-cooling dancer arm arrangement 9, which will be more fully described hereinafter, a wash tank 10, a plating arrangement 11, and various transfer pulleys 12, 13 and 14. The degreasing, washing and plating arrangements may be positioned one above the other, as shown, or arranged vertically but slightly staggered so that, for example, the wash tank 10 is slightly behind the degreasing and plating arrangements. It is also possible to arrange the degreasing, washing and plating arrangements in a line. If desired the wire supply and take-up facilities may also be positioned within the housing 7 to form a complete and self-contained electroplating plant.

Wire passes from supply reel 2, through the guide pulley arrangement 3, through a first degreasing tank 15 containing a degreasing solution, over a guide device 16, partly around drivable drum 17, through a second degreasing tank 18, over a guide device 19, partly around a rotatable drum 20, back through tank 15, and around parallel paths between drums 17 and 20 so that there are a predetermined number of loops of wire passing through the degreasing arrangement 8. Electrical contact for the supply of the necessary current required for electrolytic degreasing may be made to the wire in a conventional manner, such as via the drums 17 and 18 themselves or appropriately positioned brush arrangements, and via anodes positioned in the degreasing solution. The degreased wire passes over the pulley of the dancer arm arrangement 9, over the transfer pulley 12 and into the wash tank through which fresh water is continuously being pumped. After passing through wash tank 10, the wire passes over pulley 13 and thence to the plating arrangement 11, which is somewhat similar to the degreasing arrangement 8 and includes two rotatable drums 21 and 22, one of which, for example 21, is drivable, two tanks 23 and 24 of electrolyte (plating solution) and two guide devices 25 and 26. The wire passes in a number of loops through the plating tanks 23 and 24 during plating, and the plated wire finally emerges from tank 23, passes over transfer pulley 14, back through the wash tank 10, over guide pulley 4, and is then wound onto take-up reel 6. Anodes 27 of, for example tin for tin plating a copper wire, dip into the plating solution, for example stannous fluoroborate, in the tanks 23 and 24, and are electrically connected to the positive terminal of a d.c. source of supply (not shown), while cathode connection to the wire is made via the drums 21 and 22 which are electrically connected to the negative terminal of the d.c. source of supply.

Certain aspects of the elements contained within the housing 7 of FIG. 1 will now be described in greater detail. In a particular plating plant using stannous fluoroborate to electrotin copper wire, the total current input may be over 2000 amps and the wire throughout speed may be 750 ft. (224 meters) per minute or more. In order to keep the current taken by each individual wire loop down to a minimum, thereby minimizing the likelihood of overheating the wire, current supply to the wire is made from both of drums 21 and 22, so that current is fed into the wire at both ends of the two tanks 23 and 24, and resulting in four current feed paths for each loop of wire.

Figure 2:
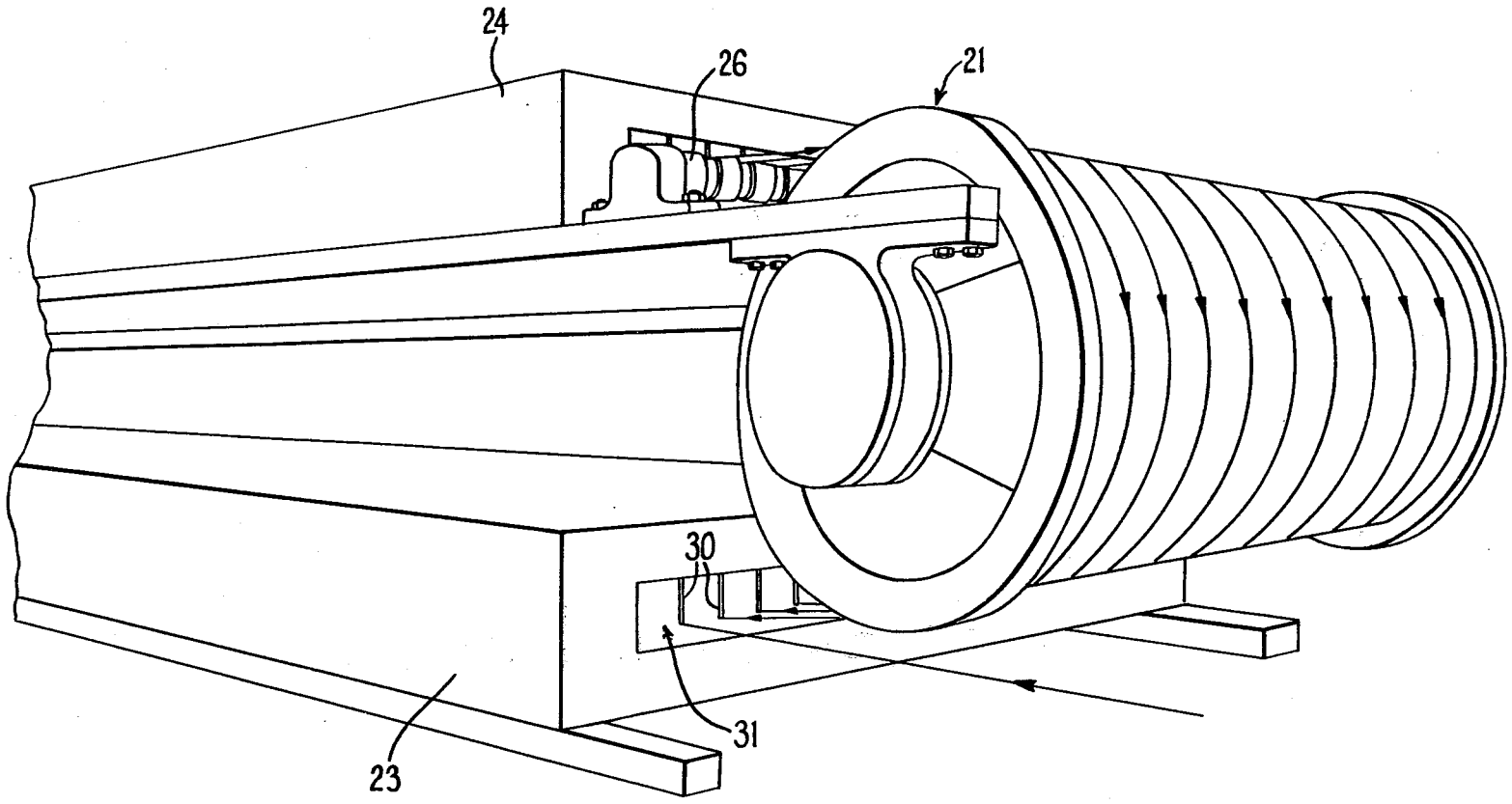
FIG. 2 shows a view of end portions of two tanks (degreasing or plating), a rotatable drum and a grooved spacing or comb guide device.

In some of the known electroplating plates, each drum is grooved and electrically-conducting at least on its grooved surface. If smooth-faced bronze drums with associated guide devices are used in place of grooved drums, as has been described above, the cost of these units is considerably reduced, and the fact that the surface of the drum then presents a more uniform value for the diameter of the drum to the wire, tends to reduce tension variations between different wire loops that may occur with grooved drums. In order to direct the wire to its correct paths guide devices 25 and 26 are positioned adjacent to the tank outlets (see FIG. 2). These guide devices may be manufactured from various materials, notably plastics, and may comprise round cross-sectional rods in which circumferential grooves have been machined, the wire being passed around the rod and each loop being positioned in a different groove. The guide devices may be mounted within provision for rotation so that in the case of round grooved rods, the useful life can be increased by periodically rotating and locking the rod in another position so that it presents a new and unworn face to the wire. The guide devices may alternatively be manufactured from sheet material and be partially slotted, i.e. "hair comb" shaped, although these would not have such a long useful life as a grooved rod.

Figure 5:
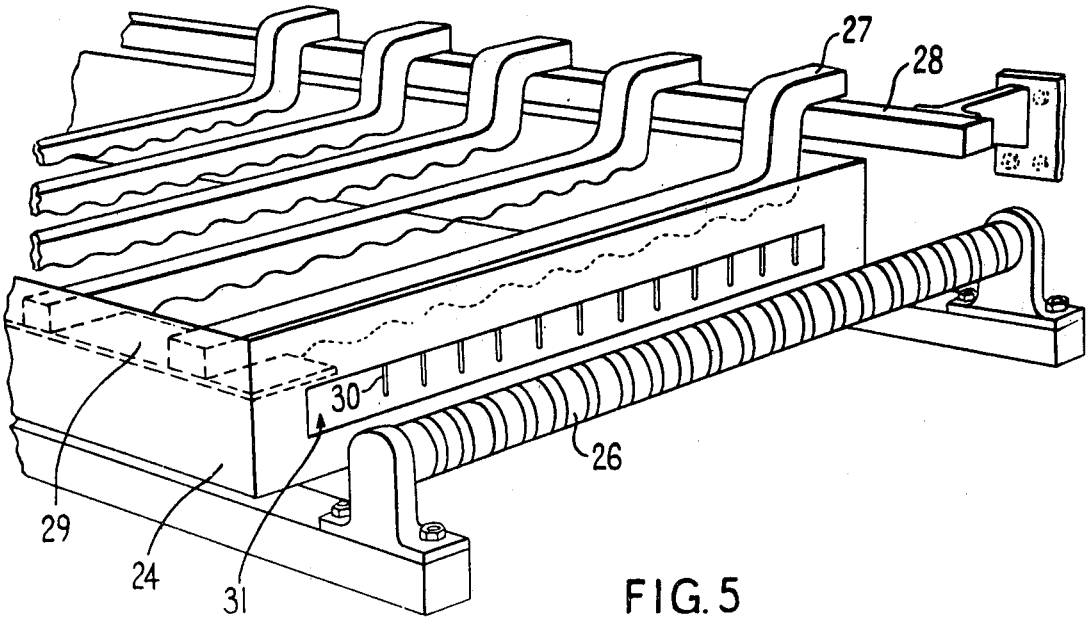
FIG. 5 shows a view of one plating tank together with a grooved spacing device and one type and arrangement of anodes.

As has been previously mentioned, and as is generally indicated in FIG. 1, the anodes 27 are positioned above the wire in the plating tanks 23 and 24 and are connected via a bus bar to the positive terminal of a d.c. source of supply. As shown in FIG. 5, a bus bar 28, of, example, bronze, may be used to connect the anodes of one tank to the positive terminal. The anodes 27 shown in FIG. 5 comprise generally step-shaped elements, and may be of die cast construction. The lower long face of the anodes 27 is shown to have a corrugated cross-section, but it can alternatively be smooth, and it generally is smooth when used in connection with the plating of wires of up to 3mm, diameter. The corrugations provide an increased anode surface area which is necessary for use with wire diameters greater than 3mm, when the correct ratio of cathode to anode surface areas is important for efficient plating.

The anodes 27 are supported at one end of the bus bar 28, and rest with their other ends on a shelf or ledge 29 provided in the tank. This arrangement ensures very quick and easy changing of anodes. During plating the long arms of the anodes are covered by plating solution. As can be seen, the anodes are each at right angles to the direction of wire passage, and in practice there is only a very small space between adjacent anodes, for example ¼ inch (6.35 mm). Plating solution is continually pumped into the tanks 23 and 24, in a conventional manner, during plating in order to maintain the level of the plating solution, since the latter continuously escapes from the tanks via slots 30 at their ends which are provided for wire passage.

At each end of the tanks 23 and 24 is a weir arrangement 31 (FIGS. 2 and 5) which is a compound construction and includes an outer rigid part in which the slots 30 are formed. The rigid part is, for example, made of rigid polyvinyl chloride. Behind the rigid part of the weir arrangement, that is within the tank, is a flexible strip of, for example polyvinyl chloride, which is slotted vertically at the wire positions. This flexible strip assists in maintaining fluid within the tanks. Similar weir arrangements are used for all of the plating and degreasing tanks.

The plating tanks 23 and 24 may be made of rigid polyvinyl chloride, and the plating solution may, for example, enter them at two positions in their bases, the height of solution in the tanks being controlled by adjusting the solution inflow rate. Conventional plating plants employing stannous sulphate use stainless steel tanks, but this leads to contamination of the tin plating, when using stannous fluoroborate, which is caused by the plating out of iron from the stainless steel.

The fact that all of the wire loop sections passing through any one of the plating tanks are moving in one direction and at high speed normally leads to a fluid gradient along the tank with the fluid effectively being dragged by the wires to one end of the tank and causing it to spill over the end wall. However, by arranging the anodes 27 above the wire in the tanks in the manner described above, the fluid gradient is controlled and the chances of spill over are eliminated or at least reduced. There are two reasons why this positioning of the anodes effectively controls the fluid gradient. Firstly, it provides a hydrodynamically "rough" surface above the wire paths which, in addition to the effect of the tank base, which is made of a solid material and is, therefore, hydrodynamically referred to as "rough", greatly reduces the kinetic energy of the fluid in the tank by reducing the fluid velocity at the top surface of the fluid in the tank. Secondly, it results in a considerable reduction in the top surface area of the fluid at which the surface pressure needs to be at atmospheric pressure, thereby reducing possible vertical flow of fluid caused by the increased fluid pressure at the wire path which results from the hydrodynamic drag.

Figure 3:
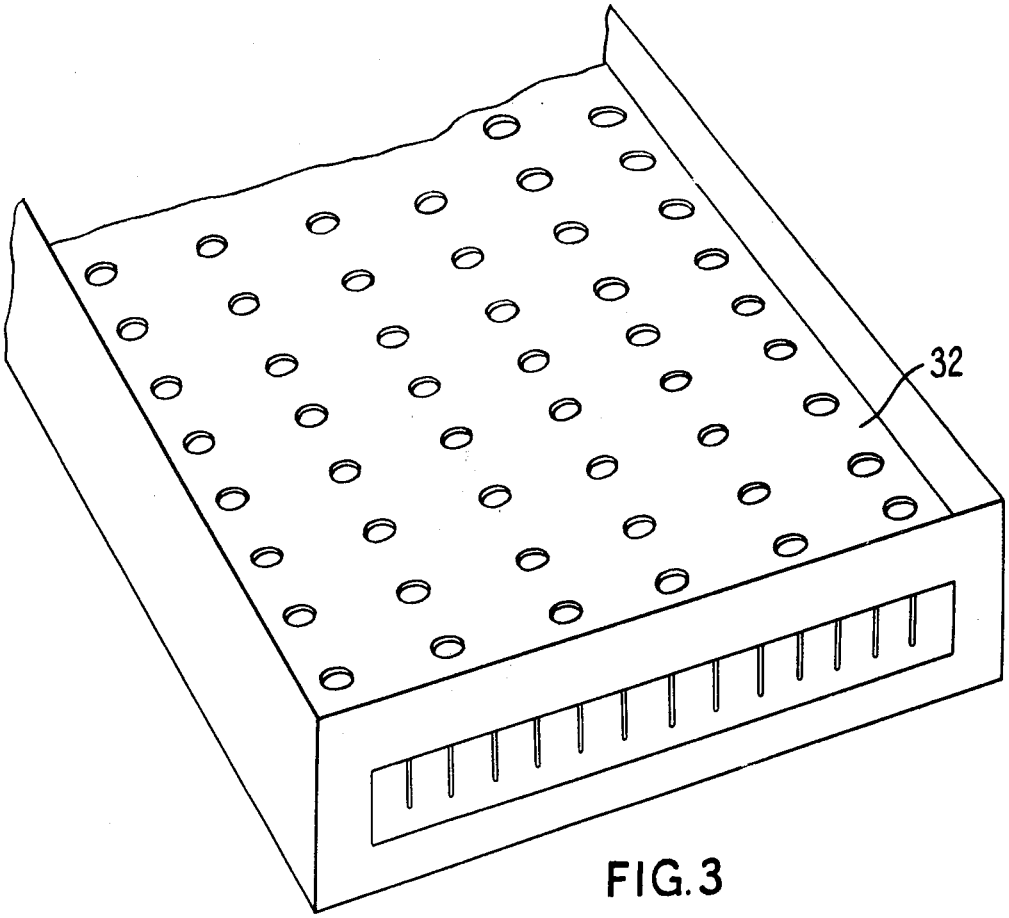
FIG. 3 shows a view of an end portion of a degreasing tank with a flow stabilizer plate therein.

Similar hydrodynamic drag effects are normally also associated with the degreasing tanks when the wire sections are all moving in one direction and at high speed. These effects are overcome in the apparatus of the present invention by use of a perforated metal plate 32, called a flow stabilizer plate, as shown in FIG. 3. The plate 32 is positioned over the wire paths in a tank and degreasing fluid pumped into the tank, from one or more positions at its base, at such a rate that the plate is fully covered with fluid. The area occupied by the holes in the plate is far less than the solid area of the plate. The flow stabilizer plate controls the fluid gradient in the degreasing tank in exactly the same manner as results from the positioning of the anodes above the wire paths. The degreasing tanks are made of stainless steel to act as anodes, and their weir arrangements, made of both rigid and flexible polyvinyl chloride, are as described above.

In order to degrease the wire passing through the degreasing tanks effectively, the wire must be immersed for at least a predetermined minimum amount of time, at a predetermined cathode current density, in a degreasing solution such as a caustic solution. With the higher plating rates that are obtainable with stannous fluoroborate solutions, for example, the wire speed through the degreasing tanks is higher than previously, and so the number of loops of wire passed over the drums 17 and 18 and through the tanks 15 and 16 must be increased, in comparison with the use of slower plating rates, in order to ensure that the wire is properly degreased. With the very high speeds generally involved with the inventive type of plating plant, at least 750 ft. (229 meters) per minute and possibly 2000 ft. (610 meters) per minute or greater, the number of wire loops has to be increased to such an extent that the wire is no longer able, because of its limited breaking strength, to be pulled through the degreasing apparatus purely by the take-up reel 5 and by driving of one of the plating drums. This is particularly true when considering the additional loading placed on the wire through the high rates of acceleration of deceleration that can be expected when using high wire throughout speeds, if stopping and starting times, respectively, are not to be unduly prolonged. These times may be nominally set at, for example, one minute. To compensate for this limitation, in the apparatus of the present invention, one of the plating drums and one of the degreasing drums are driven, the drive of the degreasing drum, for example drum 17, being directly related to the drive speed of the driven plating drum, for example drum 21. The tension-controlling dancer arm arrangement, 9 is provided for this purpose, and is positioned in the wire transfer path between the degreasing tank 18 and the transfer pulley 12 and is such as to permit a variation of ±5% in the speed of the driven degreasing drum with respect to the speed of the driven plating drum, so that the wire does not have to work to pull itself through the degreasing tanks, with a subsequent improvement in wire quality.

Figure 4:
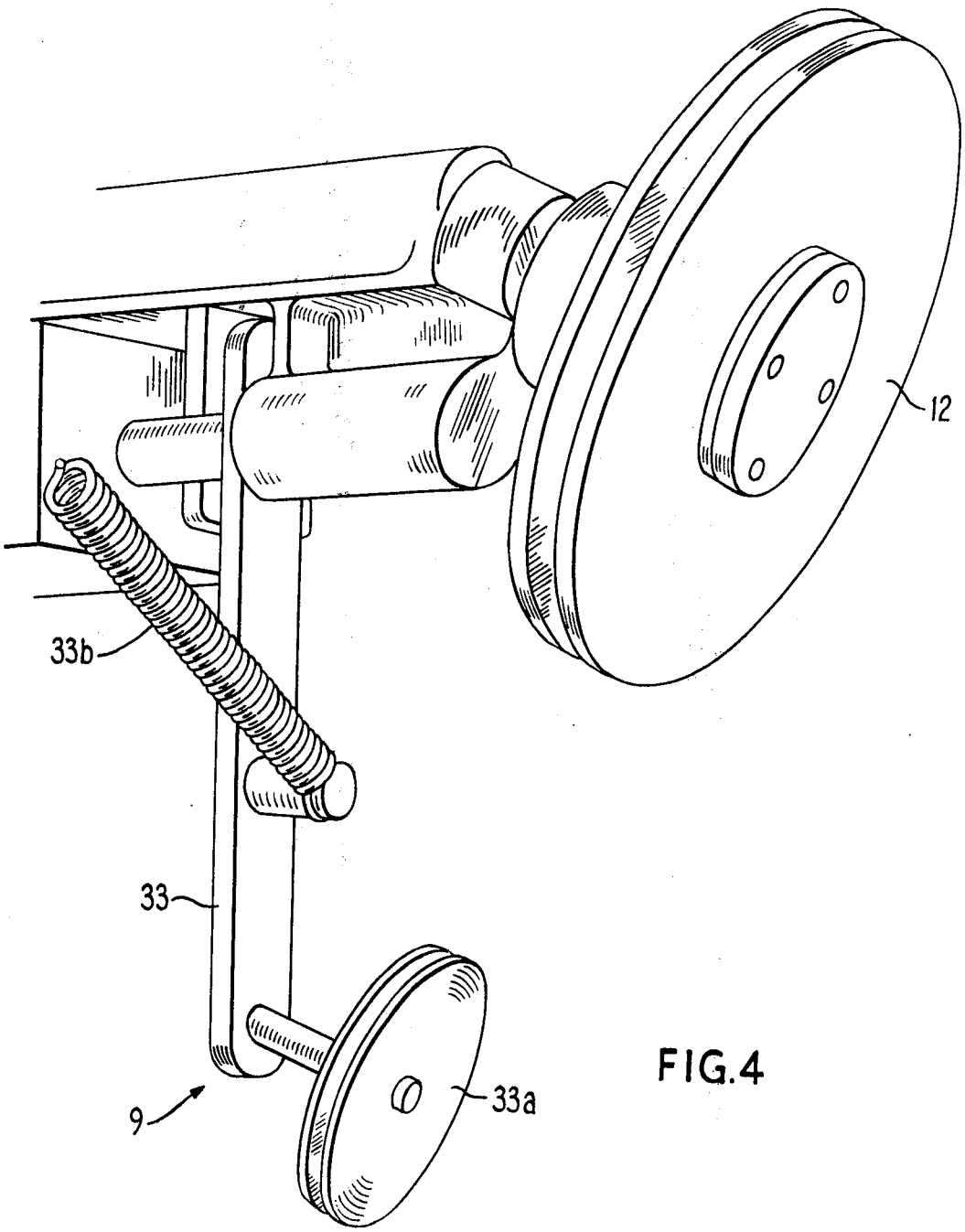
FIG. 4 shows a view of a tension-controlling dancer arm arrangement which is positioned between the degreasing tanks and a washing tank.

As shown in FIG. 4, the dancer arrangement includes a pulley 33*a*, over which wire from the degreasing arrangement passes, mounted on the end of a pivotable arm 33 which is prestressed by a spring 33*b*. The arm 33 is arranged such that pivoting movement thereof produces a corresponding variation in the value of an electrical resistance. The dancer arrangement therefore provides an accumulation of wire between the drum 20 and the pulley 12, or permits a decrease in the length of wire therebetween, in dependence on the wire tension which is therefore balanced against the tension of the spring, thus correspondingly altering the value of the electrical resistance and the speed of the drum 17, by means of an electrical control circuit, which will be described hereinafter.

In order to reduce errors in plating thickness when increasing or decreasing the wire speed, such as when stopping and starting the plant in order to change take-up and supply reels, a drive speed/plating current proportioner control system is used. This ensures that the ratio of drive speed to plating current remains constant over the full plating current range, and by knowing the wire diameter, etc., this ratio can be accurately preset for any given plating thickness by means of a variable control element in the control systems circuit. One control system is shown schematically in FIG. 6. This system operates on the principle of adjusting the wire speed as a direct porportion to the plating current, although it is alternatively possible to use systems based on the principle of adjusting the plating current as a direct proportion to the wire speed. The cost of the latter is considerable however, and the former is thus preferred.

Figure 6:
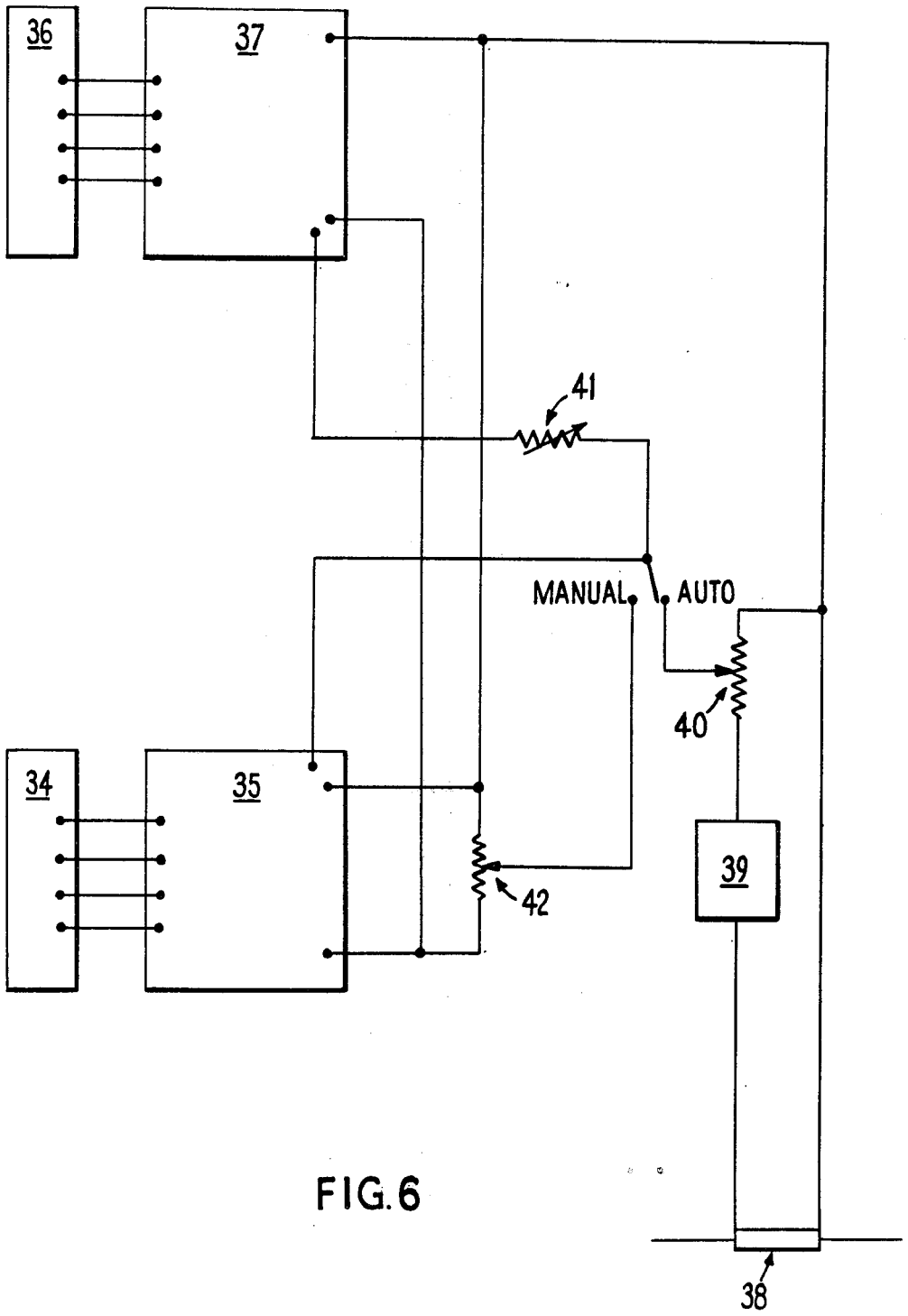
FIG. 6 illustrates, in an electrical block circuit diagram, one control circuit arrangement for the apparatus.

The plating drum 21 is driven and controlled by a variable speed control unit 34 which has an associated unit controller 35. The unit 34 may for example include a 5 horsepower motor. The degreasing drum 17 is driven and controlled by a further variable speed control unit 36, which may for example include a 3 horsepower motor, and has an associated unit controller 37. The controllers 35 and 37 control the units 34 and 36, that is control the rotational speeds of the drums 21 and 17, in dependence on a reference signal which, in the control system shown in FIG. 6, is related to the plating current. This reference signal is obtained by taking the voltage drop across a current shunt 38 situated in the plating current supply path and operating on it by means of amplifier 39 and potentiometer 40. The potentiometer 40 is calibrated so that it may be preset to correspond to particular drive speed to plating current ratios, and therefore comprises a ratio control or proportioner element. A variable resistance 41 adjusts the reference signal as applied to the controller 37 in dependence on the movement of the dancer arm 33, and is the variable electrical resistance previously mentioned. While the drive of the degreasing drum is, therefore, directly related to the drive and drive speed of the plating drum, a ±5% variation in the rotational speed of the degreasing drum is possible in order to compensate for wire tension variations. This variation in the rotational speed of the degreasing drum is performed automatically. The supply of a reference signal to the controller units 35 and 37 may also be controlled manually by switching the system to the "Manual" position and adjusting the potentiometer 42 in order to provide the desired plating and degreasing drum drive speeds, the degreasing drum drive speed still being subject to a ±5% variation with regard to the plating drum drive speed in dependence on the wire tension.

Figure 7:
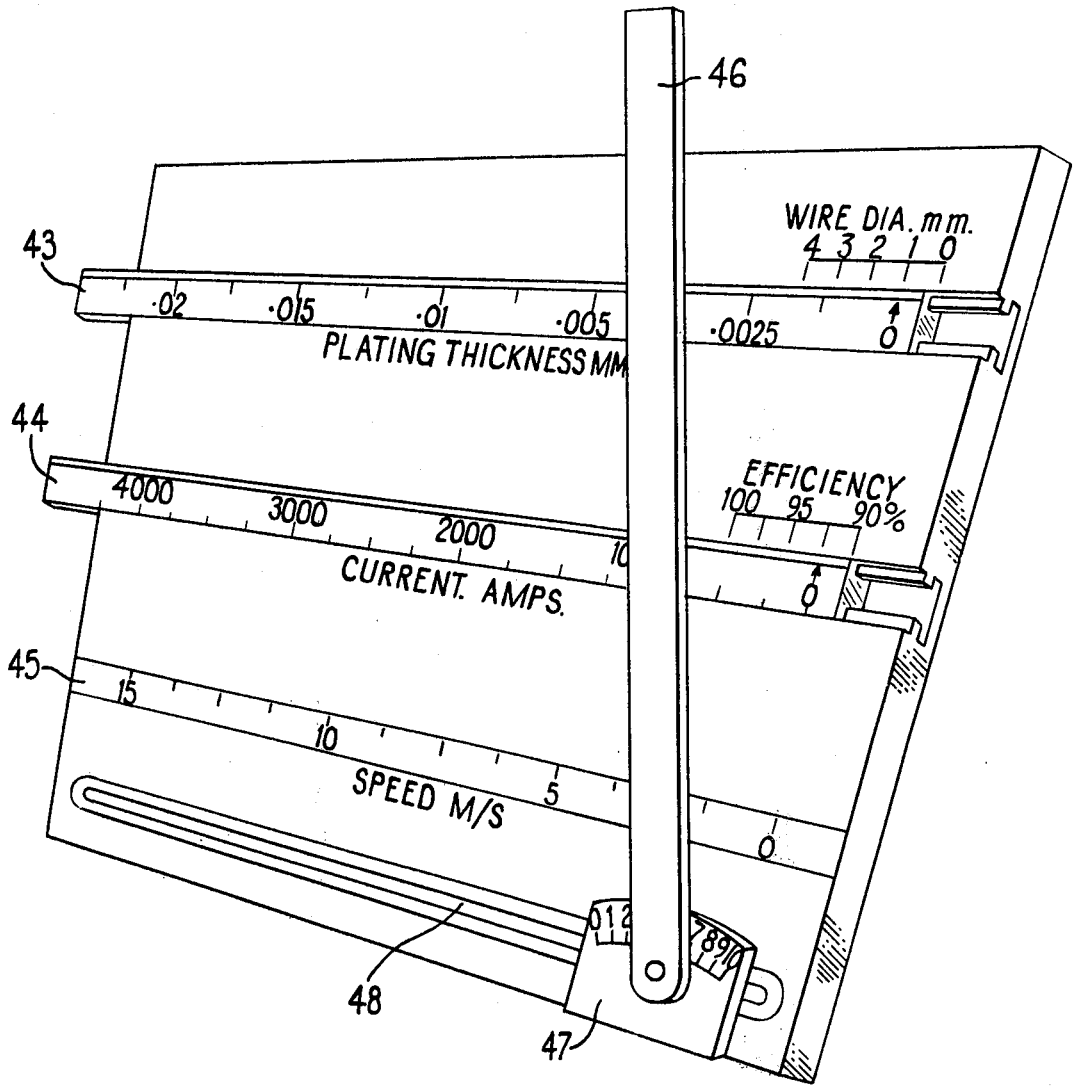
FIG. 7 shows a "slide rule" device useful for quickly determining necessary plating currents for particular plating thicknesses on particular wire diameters, etc.

Since there are many variable quantities involved with the plating plant, the slide rule device shown in FIG. 7 was developed in order to permit required current settings, etc., to be rapidly ascertained. The device shown in FIG. 7 includes a slider 43 graduated in terms of plating thickness (0 to 0.025 millimeters), which is movable relative to a fixed scale graduated in terms of wire diameter (0 to 4 millimeters), a slider 44 graduated in terms of plating current (0 to 4500 amps), which is movable relative to a fixed scale which is graduated in terms of plating efficiency (90 to 100%) and a fixed scale 45 which is calibrated in terms of wire throughput speed (0 to 900 meters per minute). The cursor of the slide rule device comprises an arm 46 which is pivotable with respect to slider 47 and can be set at any angle corresponding to a desired proportioner (speed to plating current) ratio (0 to 10), the ratio control element 40 of FIG. 6 also being calibrated between 0 and 10. The slider 47 is movable along the length of the device in a slot 48. The slide rule device may be used, for example, in the following manner. The sliders 43 and 44 are moved so that their zeros are set to the wire diameter being used and the appropriate plating efficiency. The proportioner arm 46 is then pivoted about its pivot axis and the slider 47 moved in slot 48, so that, for a particular required plating thickness, sets of appropriate values of plating current, wire speed and associated proportioner setting can be read off. The device may be such that the proportioner ratio, etc., are read off by the position of the left-hand side of arm 46, or alternatively the arm 46 could be transparent, and a reference line marked at a central position along its length. The device is produced with the aid of sets of known operating variables and conditions for a particular plant and is thus precalibrated.

In a typical plating plant of the above-described construction, the degreasing tanks are approximately 2 meters (6 feet) long, the plating tanks are approximately 2 meters (6 feet) long, and for a copper wire which is 3 millimeters in diameter, the wire is looped 13 times around the degreasing drums and 32 times around the plating drums. In order to obtain a tin plating thickness of $4 \times 10^{-3}$ millimeters at a plating current of 2,000 amps, a cathode current density of approximately 4,304 amps per square meter (400 amps per square ft.), a wire throughput speed (plating drum drive speed) of 274 meters per minute (900 ft. per minute), at a running temperature (plating tank temperature) of approximately 15° C (60° F), and with the plating solution comprising 25 liters Concentrate to 100 liters Solution, (the Concentrate containing 50% $Sn(BF_4)_2$) 5.99 grams per litre (0.06 lbs. per gallon) of glue or gelatin, and 1.00 grams per liter (0.01 lbs. per gallon) of $\beta$-naphthol. Typically the degreasing solution includes 124.79 grams per liter (1.25 per gallon) of sodium hydroxide and 99.83 grams per liter (1lb. per gallon) of sodium metasilicate, and degreasing takes place at a cathode current density of 2,145 amps per square metre (200 amps per square ft.). Copper wire electrotinned in the above-described manner is subsequently drawn down to a required diameter by conventional wire drawing apparatus.

While the invention has been basically described with respect to stannous fluoroborate for electrotinning a copper wire, the same apparatus can be used in connection with electroplating using other fluoroborate based plating solutions, or other high current density plating solutions. For example it can also be used for electroplating lead, nickel, zinc or a tin/lead solder alloy (in any predetermined ratio) onto copper or steel wire. It is also possible to use the same apparatus to obtain a corrosion resistant colored wire by, for example, electroplating zinc onto a copper or steel wire from a plating solution to which a coloring dye has been added. After plating, this wire can be drawn down to the required size on a conventional wire drawing machine. This process for coloring wire is far simpler and cheaper than the conventional coating of wire with a colored plastics material after a final drawing operation. Such corrosion resistant colored wire may be used for making paper clips etc. It is also alternatively possible to have only one tank in both the degreasing and plating arrangements, or to have more than two tanks, although for practical purposes two tanks, one above the other, is preferable from the point of view of efficiency and economy of space.

While we have described above the principles of our invention in connection with specific apparatus, it is to be clearly understood that this description is made only by way of example and not as a limitation to the scope of our invention as set forth in the objects thereof and in the accompanying claims.

What is claimed is:

1. Apparatus for continuously depositing a metal coating on a longitudinally moving wire comprising a degreasing tank adapted to contain a degreasing solution, a plating tank adapted to contain an electrolyte comprising a salt of the metal to be deposited, a source of direct current, first means for passing the wire a plurality of times through said degreasing tank, said first means including two rotatable drums about which the wire is passed each time in a loop, at least one of said drums being drivable, second means for passing the degreased wire a plurality of times through said plating tank, said second means being positioned in the wire path between said degreasing tank and plating tank and including two rotatable plating drums about which the wire is passed each time in a loop, at least one of said plating drums being drivable and at least one of said plating drums being connectible to the negative pole of said source of direct current, and a plurality of anodes connectible to the positive pole of said source and extending into said plating tank and adapted to extend into said electrolyte, means for sensing plating current, and drive means for said drivable plating drum and said drivable degreasing drum, means for inter-relating said drivable drums such that in dependence on the wire tension a predetermined amount of variation in the speed of the wire through the degreasing tank with respect to the speed through the plating tank is permitted, said inter-relating means being positioned between said degreasing and plating tanks and between said drivable drums of said first and second means, and including a dancer arm and a pulley mounted on said dancer arm adapted to direct degreased wire from said degreasing tank towards said plating tank, said dancer arm being spring biased and pivotable against the spring force in dependence on the wire tension, and a variable resistor and control circuit for adjusting the relation of wire speed to plating circuit, said pivotable dancer arm varying said resistor to adjust said relation.

2. Apparatus as claimed in claim 1, wherein there are two plating tanks and two degreasing tanks, the two plating tanks being arranged one above the other, and the two degreasing tanks being arranged one above the other.

3. Apparatus as claimed in claim 1, wherein the degreasing and plating drums have smooth faces around which the wire loops pass, and including guide means for each said degreasing and plating tank for guiding the wire onto the associated drum and keeping different loops separate.

4. Apparatus as claimed in claim 3, wherein the guide means comprise grooved cylindrical rods whose longitudinal axes extend parallel to the axes of rotation of the drums.

5. Apparatus as claimed in claim 4, wherein the guide means comprise partially slotted comb-shaped structures.

6. Apparatus as claimed in claim 1 wherein said anodes are blocks of metal arranged in the plating tank above the sections of wire loops passing through the tank and substantially normally to the direction of movement of the wire loop sections.

7. Apparatus as claimed in claim 6, wherein said plating tank includes a ledge along one side and a bus bar conductor along the other side, said anodes being step-shaped and having one portion adapted to be covered by said electrolyte and supported on said ledge and another portion supported on said bus bar and being connectible to said positive pole at a distance from said electrolyte.

8. Apparatus as claimed in claim 7, wherein a plurality of anodes are supported across said plating tank and arranged at a minimum separation distance between adjacent anodes along the length of the tank as to provide a hydrodynamically rough surface above the wire loop sections.

9. Apparatus as claimed in claim 8, wherein the surface of the anodes adjacent the wire loop sections is corrugated.

10. Apparatus as claimed in claim 8 including an apertured flow stabilizer plate in said degreasing tank above the sections of wire loops passing therethrough, said plate being adapted to be covered by degreasing solution and providing a hydrodynamically rough surface above the wire loop sections.

11. Apparatus as claimed in claim 8 including weirs at the ends of each of said degreasing and plating tanks, said weirs including a slotted end plate.

12. Apparatus as claimed in claim 11, wherein each plate and degreasing tank is rigid polyvinyl chloride, and said weir plate is of rigid polyvinyl chloride.

13. Apparatus as claimed in claim 8 including a wash tank positioned in the wire path between the degreasing and plating tanks.

14. Apparatus as claimed in claim 8 including control means for automatically adjusting wire speed in proportion to plating current.

* * * * *